US009982577B2

(12) United States Patent
Kohrs et al.

(10) Patent No.: US 9,982,577 B2
(45) Date of Patent: May 29, 2018

(54) CAMSHAFT ADJUSTING DEVICE

(71) Applicant: Schaeffler Technologies AG & Co. KG, Herzogenaurach (DE)

(72) Inventors: Mike Kohrs, Oberreichenbach (DE); Jens Schaefer, Herzogenaurach (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 18 days.

(21) Appl. No.: 15/314,367

(22) PCT Filed: Mar. 31, 2015

(86) PCT No.: PCT/DE2015/200219

§ 371 (c)(1),
(2) Date: Nov. 28, 2016

(87) PCT Pub. No.: WO2015/185043

PCT Pub. Date: Dec. 10, 2015

(65) Prior Publication Data

US 2017/0101905 A1 Apr. 13, 2017

(30) Foreign Application Priority Data

Jun. 2, 2014 (DE) ..... 10 2014 210 360

(51) Int. Cl.
*F01L 1/34* (2006.01)
*F01L 1/352* (2006.01)
*F01L 1/344* (2006.01)

(52) U.S. Cl.
CPC ..... *F01L 1/352* (2013.01); *F01L 1/3442* (2013.01); *F01L 2001/3444* (2013.01); *F01L 2001/34436* (2013.01); *F01L 2810/02* (2013.01)

(58) Field of Classification Search
CPC . F01L 1/352; F01L 1/3442; F01L 2001/3444; F01L 2001/34436; F01L 2810/02
See application file for complete search history.

(56) References Cited

U.S. PATENT DOCUMENTS

2008/0264365 A1* 10/2008 Kohrs ..... F01L 1/352 123/90.17
2010/0180845 A1 7/2010 Kurisu et al.
2012/0312258 A1 12/2012 Kimus et al.

FOREIGN PATENT DOCUMENTS

DE 102005018956 A1 11/2006
DE 102005059860 A1 7/2007
(Continued)

*Primary Examiner* — Zelalem Eshete
(74) *Attorney, Agent, or Firm* — Adam R. Southworth

(57) ABSTRACT

A camshaft adjusting device, wherein said camshaft adjusting device has a lubricant supply unit, wherein the lubricant supply unit has a filter device for filtering the lubricant, wherein the filter device has at least one lubricant inlet, at least one lubricant outlet and at least one filter path, wherein the lubricant inlet and the lubricant outlet are fluidically connected to each other by way of the filter path, and wherein an output shaft of the camshaft adjusting device has two wall sections, wherein the at least one filter path is configured in a filter volume between the two wall sections, and wherein the lubricant inlet is at a smaller distance from the axis of rotation than the lubricant outlet, and the filter path extends at least in sections in the radial direction with respect to the axis of rotation.

10 Claims, 4 Drawing Sheets

(56) References Cited

FOREIGN PATENT DOCUMENTS

| | | | |
|---|---|---|---|
| DE | 102008043987 | A1 | 5/2009 |
| DE | 102008010644 | A1 | 8/2009 |

* cited by examiner

CAMSHAFT ADJUSTING DEVICE

CROSS-REFERENCE TO RELATED APPLICATIONS

The present application is the United States National Stage Application pursuant to 35 U.S.C. § 371 of International Patent Application No. PCT/DE2015/200219, filed on Mar. 31, 2015, and claims priority to German Patent Application No. DE 10 2014 210 360.6 of Jun. 2, 2014, which applications are incorporated by reference in their entireties.

FIELD

The invention relates to a camshaft adjusting device for a vehicle with a variator for adjusting an angular position of a camshaft; wherein the variator comprises an input shaft that can be coupled to a crankshaft, an output shaft that can be coupled to the camshaft, and an adjusting shaft that can be coupled to an actuator; wherein the variator defines an axis of rotation; wherein the variator forms an internal gear space; wherein the input shaft, the output shaft and the adjusting shaft are operatively connected to each other in the internal gear space, wherein the camshaft adjusting device has a lubricant supply unit for supplying the internal gear space with a lubricant; wherein the lubricant supply unit comprises a filter device for filtering said lubricant; wherein the filter device has at least one lubricant inlet, at least one lubricant outlet, and at least one filter path; wherein the lubricant inlet and the lubricant outlet are fluidically connected to each other by means of the filter path.

BACKGROUND

Camshaft adjusters are used to adjust the relative angular position between the crankshaft and the camshaft of an internal combustion engine. Such camshaft adjusters typically comprise a drive member, which is coupled to the crankshaft, for example, by means of a chain or a belt; an output member, which is usually coupled to the camshaft in a rotationally fixed manner; and an adjusting shaft, which makes it possible to adjust an angular position of the output member relative to the drive member.

The drive shaft, the adjusting shaft and the output shaft come into operative connection with each other in a transmission, so that the net result is mechanical friction in the transmission due to the bearing arrangements and the mutual interference. In order to reduce the mechanical friction, it is customary to lubricate the transmission of the camshaft adjuster with oil.

For example, the publication DE 10 2005 059 860 A1, which is most likely the closest prior art, discloses a lubricant circuit of a camshaft adjuster. In the lubricant circuit a lubricant is fed to the camshaft adjuster by way of the camshaft and is discharged again through the outlet ports. Integrated into the lubricant circuit is, among other things, a filter screen, in order to filter out the dirt particles in the lubricant.

SUMMARY

The objective of the invention is based on providing an operating method for an internal combustion engine showing variable control times, which is particularly suitable for operating phases below the idling speed, particularly for vehicles with a start-stop system.

The object of the present disclosure is to propose an improved lubricant supply for a camshaft adjusting device. Example embodiments of the invention will become apparent from the dependent claims, the following description and the accompanying figures.

The invention proposes a camshaft adjusting device, which is designed, in particular, for an engine, especially for an internal combustion engine, of a vehicle. Optionally the camshaft adjusting device comprises a camshaft, wherein the camshaft is designed to control the valves of the engine.

The camshaft adjusting device has a variator designed as a triple shaft transmission. The variator comprises an input shaft, an output shaft and an adjusting shaft. The input shaft can be coupled, for example, to the crankshaft of the motor by means of a chain or a belt. The output shaft is coupled or can be coupled to the camshaft in a torsion proof manner. In particular, the input shaft forms a drive member; and the output shaft, an output member. In contrast, the adjusting shaft can be coupled or is coupled to an actuator. The actuator can be arranged with respect to the motor in such a way that it is rigidly mounted in the housing or can be arranged to rotate with said motor. The actuator may be implemented, for example, as a motor, in particular, an electric motor or as a brake. Optionally the camshaft adjusting device comprises the actuator.

The variator is designed to adjust an angular position of the camshaft. In particular, the variator is designed to change the angular position of the camshaft relative to the angular position of a crankshaft of the engine. As an alternative or in addition, the variator is designed to adjust the angular position between the input shaft and the output shaft. By adjusting the angular position it is possible to move the opening times and/or closing times of the valves of the engine in the direction of "early" or "late".

The variator, in particular, the input shaft and/or the output shaft and/or the adjusting shaft define(s) a common axis of rotation of the variator.

In principle, the variator may be designed as a swashplate gear mechanism, an eccentric gear mechanism, a planetary gear unit, a cam gear mechanism, a multi-articulated gear mechanism or, more specifically, a coupled gear mechanism, a friction gear mechanism, a helical gear mechanism with a threaded spindle as the speed increasing stage or as a combination of individual types of construction in a multi-stage design.

In an example embodiment, the variator is designed as a wave gear, where in this case said wave gear comprises a rolling bearing and a deformable steel bushing, which has external gear teeth and which is disposed on the rolling bearing. The adjusting shaft is designed, in particular, as a wave generator; and the output shaft, as an output ring gear with internal gear teeth. In the case of a planetary gear unit, it is provided that the input shaft is designed as a ring gear; the adjusting shaft as a sun gear; and the output shaft as a planet carrier, where in this case the planets of the planet carrier mesh with the ring gear and the sun gear.

The variator forms an internal gear space, where in this case the input shaft, the output shaft and the adjusting shaft are operatively connected to each other in the internal gear space. In particular, the variator is designed as a summation transmission, where in a rotary motion of the adjusting shaft be added to the rotary motion of the input shaft; and in this way the angular position is adjusted.

The camshaft adjusting device, in particular the variator, has a lubricant supply unit for supplying the internal gear space with a lubricant. In particular, the lubricant is designed as an oil, especially as a transmission oil. The lubricant supply unit is designed as a continuous supply unit, so that the lubricant is continuously supplied to and removed from the internal gear space.

The lubricant supply unit has at least or exactly one filter device for filtering the lubricant. In particular, the filter device is used to remove at least temporarily or permanently the dirt particles in the lubricant from the lubricant. The filter device comprises at least one lubricant inlet, through which the lubricant is fed into the filter device, and at least one lubricant outlet, through which the lubricant is discharged from the filter device. In this context it can be provided that the filter device has exactly one lubricant inlet and/or exactly one lubricant outlet or a plurality of lubricant inlets and/or a plurality of lubricant outlets. Between the at least one lubricant inlet and the at least one lubricant outlet there extends a filter path, over which the lubricant is fed and can flow from the at least one lubricant inlet to the at least one lubricant outlet. The filter path can be designed as a filter path network, where in this case the individual sections of the filter paths divide and are united again elsewhere. As an alternative, the filter path is designed as an unbranched filter path.

The output shaft has two wall sections, where in this case a filter volume is arranged between the two wall sections. The at least one filter path or the filter path network runs in the filter volume. Each of the wall sections extends in a radial plane with respect to the axis of rotation. In particular, the two wall sections face each other and/or are parallel to each other. Due to the fact that the wall sections are arranged in the output shaft, they rotate at the angular velocity of the output shaft.

In an example embodiment, the lubricant inlet is arranged on the same or a smaller pitch circle diameter with respect to the axis of rotation than the lubricant outlet. In particular, the at least one lubricant inlet and the at least one lubricant outlet are arranged in an axial plan view so as not to overlap with respect to the axis of rotation and/or are offset from each other. Due to the fact that the lubricant inlet and the lubricant outlet are arranged the same with respect to the radial distance from the axis of rotation or are even offset from each other, and due to the fact that the filter device is formed by the wall sections of the output shaft, it is ensured that when the camshaft adjusting device is working, the output shaft and, thus, the filter device rotates at the angular velocity of the camshaft, so that the lubricant is conveyed from the at least one lubricant inlet to the at least one lubricant outlet by means of centrifugal force.

In addition, the filter path extends at least in sections in the radial direction and optionally also in the tangential direction or the circumferential direction about the axis of rotation. Due to the fact that the filter path runs in the radial direction, it is ensured that said filter path achieves a sufficient length without enlarging the installation space of the camshaft adjusting device.

In the event that the lubricant inlet and the lubricant outlet have the same pitch circle diameter, the filter path may also be formed as an arc-shaped channel that extends on the common pitch circle diameter.

The new approach of designing the lubricant supply unit makes it possible to achieve in comparison to the use of a conventional filter element that, on the one hand, there is no need for an additional filter element, that there is no need to provide corresponding receiving chambers for the filter element, that it is no longer possible to make a mistake in the installation of the filter element, and in terms of functionality it is also possible for the filter device to extend over a larger area without having an adverse effect on the camshaft adjusting device.

In an example embodiment, in particular the filter path guide and/or the filter path configuration is/are implemented by means of structural elements that are disposed in the filter volume.

In an example embodiment, the structural elements are arranged, in particular, formed or molded, integrally and/or in one piece on one wall section or on both wall sections. In particular, at least or exactly one of the wall sections is structured with the structuring. The structural elements can be introduced by means of a non-cutting process, such as, for example, forging, extrusion, rolling, stamping, PM or by a machining process, such as turning, milling, or chemically, such as, for example, by means of etching or by means of laser technology. This configuration ensures that only the wall sections can be structured accordingly, and these wall sections can be easily fastened to each other during the installation of the output shaft, so that the filter device can be formed without additional components that are absolutely necessary. In an example embodiment the camshaft adjusting device comprises one or more insert parts, where in this case the structural elements are arranged on the insert part. The insert part can be designed, for example, as an etched, punched or laser-cut disk or in the same mode of production as a sleeve, for example, wound of sheet metal. In this example embodiment it is easier to make the wall sections flat, for example, and to implement the filter path guide and/or the filter path configuration by means of the one insert part or the insert parts.

The structural elements can implement, as a part of the filter device, a mechanical screen for dirt particles, a centrifugal structure for separating out the dirt particles and/or a throttling of the volumetric rate of flow. In an example embodiment the structural elements have a height in the axial direction with respect to the axis of rotation D that is between 0.1 mm and 5 mm, preferably between 0.1 mm and 2 mm and, in particular, between 0.1 mm and 1 mm. The structural elements can make contact with the adjacent wall section or even be dimensioned in such a way that the structural elements can penetrate the wall section during assembly, so that there is a micro-positive locking.

In an example embodiment the structural elements form one or more flow obstacles in the filter path. The flow obstacles may be designed as solid obstacles, so that the at least one filter path extends around the flow obstacles. As an alternative, the flow obstacles may also be designed as partial obstacles, where in this case the flow obstacles do not fully connect the wall sections, but rather are designed as recesses or elevations. This arrangement makes it possible to reduce the potential flow cross-section between the wall sections in the axial direction with respect to the axis of rotation. For example, a plurality of flow obstacles can jointly form a filter screen, where in this case it is possible to adjust the mesh size of the filter screen as a function of the distance from the flow obstacles. In a filter screen that is formed in this way, the dirt particles can be filtered out of the lubricant. As an alternative, the available flow cross-section between the wall sections can be reduced by means of the partial obstacles in such a way that the result is that the dirt particles are mechanically trapped and filtered out.

In an example embodiment, it is provided that the structural elements form one or more dirt pockets, where in this case at least one dirt pocket or some of the dirt pockets or all of the dirt pockets are opened radially inwards with respect to the axis of rotation. The function of the dirt pockets consists of the feature that the dirt particles are pressed against the bottom of the pockets due to the centrifugal force and can no longer leave the dirt pockets laterally due to the radial opening of the dirt pocket inwards and, as a result, are permanently trapped. The dirt pockets may also extend in the axial direction, in order to increase the trapping volume.

In an example embodiment, the dirt pockets exhibit a dirt pocket extension at the bottom, with said dirt pocket extension extending in a direction opposite to the direction of rotation in the circumferential direction. Owing to the dirt pocket extensions a trapping volume is formed, in which the impurities are also trapped in a form-fitting manner, even if the camshaft adjusting device is stationary and, as a result, the impurities can no longer flow back into the lubricant circuit.

It is provided that the structural elements, in particular, the flow obstacles and/or the dirt pockets, are designed at least to some extent in the form of islands. As a result, the lubricant is forced to flow along the filter path around the said elements.

In this context the percentage of the area of the structural elements, in particular the island-like structural elements, which make contact with the two wall sections, so that the two wall sections can be braced against each other, makes up at least 50 percent of the total area of the filter device in an axial plan view. This feature ensures that despite the large format filter device, the wall sections are supported on one another in a sufficiently rigid manner in the axial direction.

In an example embodiment, the at least one filter path is designed at least in sections or completely as a flat channel, where in this case the flat channel extends in its two-dimensional extent in a radial plane with respect to the axis of rotation. The flat channel extends in the form of a spiral and/or in a labyrinthine manner between the at least one lubricant inlet and the at least one lubricant outlet. Due to the multiple deflections and/or meandering of the filter path, said filter path is artificially lengthened, so that the filtering action is improved.

In an example embodiment, the filter path extends, starting from the lubricant inlet, up to an outer region, which is at a greater distance from the axis of rotation than the lubricant outlet. Thereafter the lubricant is fed along the filter path in the form of a spiral and/or in a labyrinthine manner to the lubricant outlet in a return region. In this example embodiment it is ensured that the lubricant is conveyed by means of centrifugal force. However, the guide of the filter path ensures that in the return area the lubricant is guided against the centrifugal force to the lubricant outlet. Particular preference is given to the provision that one or more dirt pockets are designed along the filter path so that the dirt particles are trapped in the dirt pockets, and only the lighter and free flowing lubricant is fed to the lubricant outlet.

In an example embodiment, the at least one filter path is designed at least in sections as an annular disk and/or as an annular disk segment. Thus, in this example embodiment the filter path can extend over an angular range of less than 360 degrees or circumferentially over the entire angular range of 360 degrees. Especially in the embodiment as an annular disk the surface of the filter device is particularly large. The filter device includes a central passage.

In an example embodiment, the camshaft adjusting device comprises an outlet pocket, where in this case said outlet pocket is open radially outwards and, in addition, surrounds the at least one lubricant outlet. This configuration achieves the objective that lubricant is conveyed to the lubricant outlet. Initially said lubricant flows past the lubricant outlet and is only subsequently conveyed through the outlet pocket, which is open radially outwards, to the lubricant outlet. Similarly this fluidic resistance can be overcome only by the lubricant, but not by the dirt particles.

In an example embodiment, the camshaft adjusting device comprises a camshaft adapter, to which the camshaft can be fastened, for example, by means of a screw connection. The camshaft adapter has an end cap, which bears even more preferably a transmission member, in particular, peripheral ring gear teeth for coupling by gearing means. It is provided that the camshaft adapter has one of the wall sections; and the end cap has the other one of the wall sections. When viewed structurally, the camshaft adapter and the end caps are already provided in prior art designs, so that the introduction of structural elements for forming the filter device on the wall sections or the insertion of the insert part can be easily implemented.

BRIEF DESCRIPTION OF THE DRAWING

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

Figure 1:
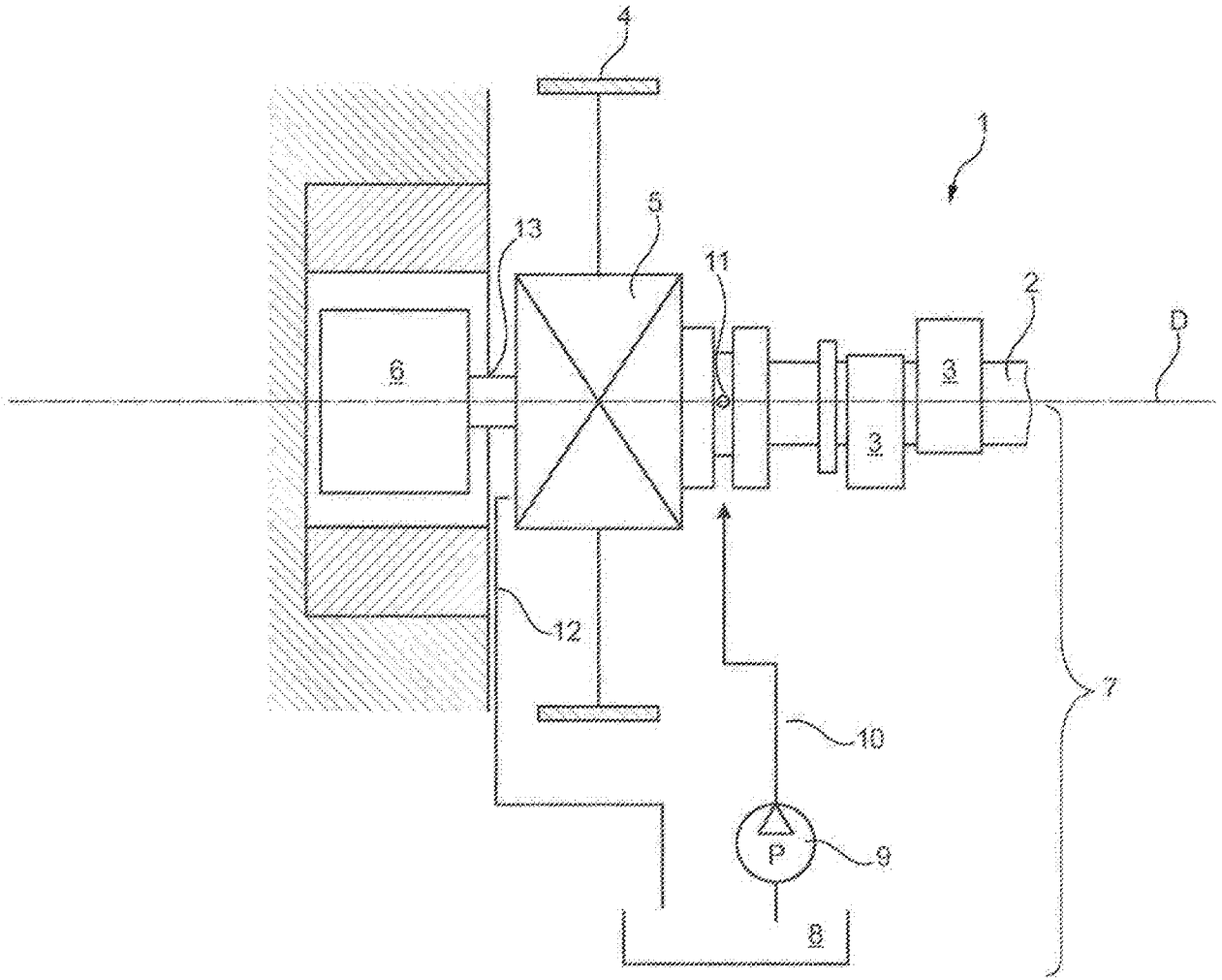
FIG. 1 is a schematic overview of a camshaft adjusting device as an exemplary embodiment of the invention.

FIG. 1 is a schematic representation of camshaft adjusting device 1 for an engine, in particular, an internal combustion engine of a vehicle, as a first exemplary embodiment of the invention. Camshaft adjusting device 1 comprises camshaft 2, which has a plurality of cams 3, which are designed to actuate the valves of the engine.

The drive of camshaft 2 is provided by way of drive gear 4, which is coupled to a crankshaft (not shown) of the engine by means of a chain, a belt or a transmission. Variator 5 is interposed between drive gear 4 and camshaft 2. Variator 5 allows an angular adjustment of camshaft 2 to be effected in a controlled fashion relative to drive gear 4 and, as a result, relative to the crankshaft (not shown). In order to control variator 5, this variator is coupled to electric motor 6 by means of motor shaft 13, which is arranged so as to be stationary relative to variator 5. That is, motor shaft 13 does not rotate along with variator 5.

Figure 2:
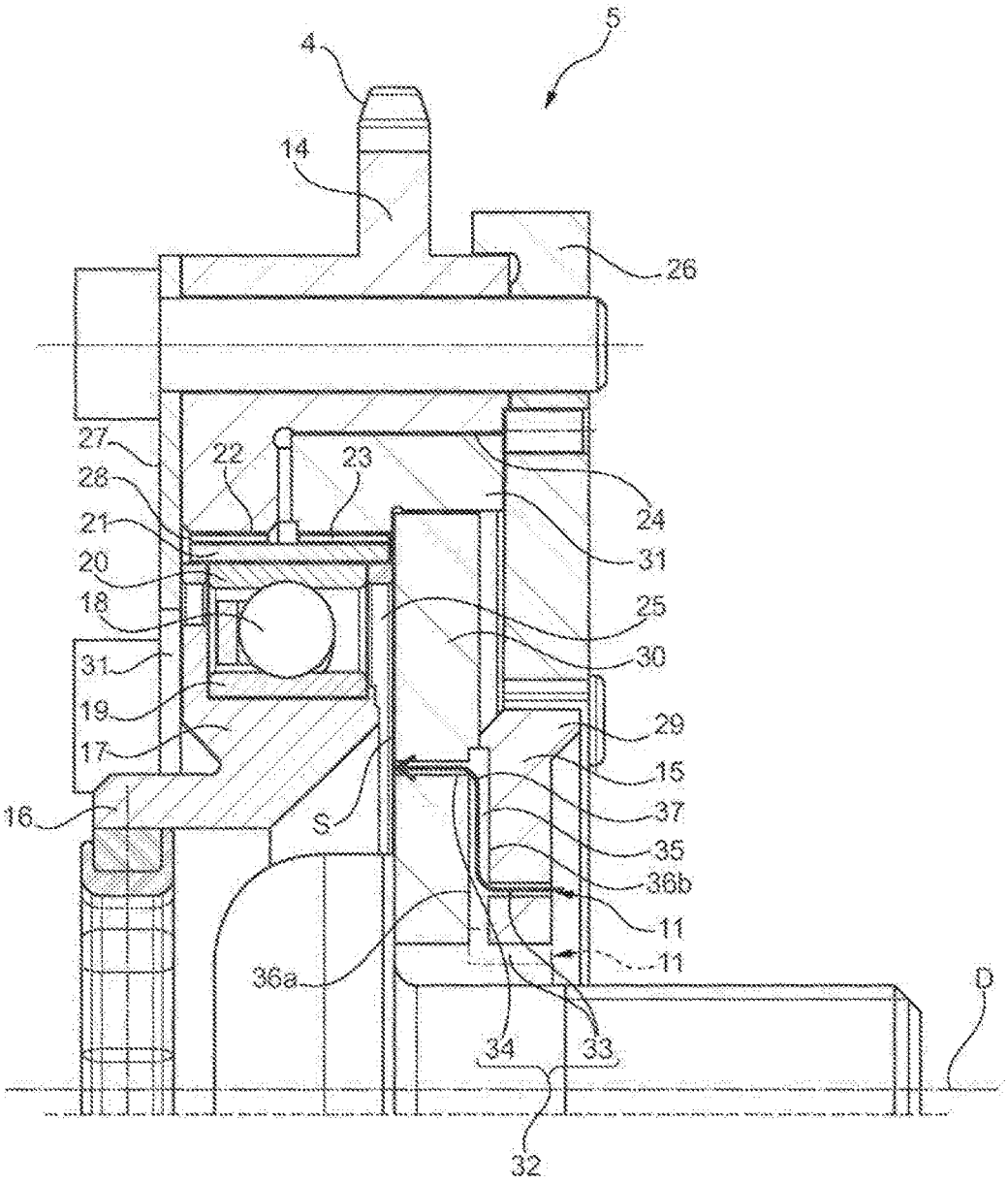
FIG. 2 is a cross-sectional view of the variator of the camshaft adjusting device in FIG. 1.

Camshaft adjusting device 1 comprises lubricant supply unit 7, which introduces, starting from an oil pan or, more specifically, oil tank 8, transmission oil as a lubricant into camshaft 2 through motor oil pump 9 by means of a rotary transmitter (not shown) for oil. The lubricant is fed from camshaft 2 through lubricant feed line 11 into variator 5, in order to lubricate variator 5 and is then discharged again from variator 5 through lubricant discharge line 12, so that lubricant supply unit 7 is designed as a lubricant circuit. FIG. 2 is a cross-sectional view of variator 5 taken along axis of rotation D, which is defined, for example, by camshaft 2 or motor shaft 13 (FIG. 1).

Variator 5 is also designed as a so-called wave gear (also called a harmonic drive gear). Wave gear 5 is also referred to as a sliding wedge gear, or a strain wave gear (SWG). Variator 5 has input shaft 14, which is coupled in a rotationally fixed manner to drive gear 4 or is formed by this drive gear. Furthermore, variator 5 has output shaft 15, which is connected to camshaft 2 in a rotationally fixed manner. In contrast, adjusting shaft 16 is connected to motor shaft 13 in a rotationally fixed manner. Adjusting shaft 16 has generator section 17, which has a cross-section that is perpendicular to axis of rotation D and which is designed so as to be not round, in particular to be elliptical. Rolling bearing 18 is disposed on said generator section in such a way that inner ring 19 of rolling bearing 18 rests on a shell surface of generator section 17; and outer ring 20 bears a deformable, cylindrical steel bushing 21 with external gear teeth. Steel bushing 21 is also referred to as a flex spline. Steel bushing 21 is designed with a cross-section, which is perpendicular to axis of rotation D, and is designed to be elliptical as well.

Input shaft 14 bears internal gear teeth 22, which mesh with the external gear teeth of steel bushing 21. Output shaft 15 bears internal gear teeth 23, which also mesh with the external gear teeth of steel bushing 21. By rotating adjusting shaft 16 at an angular velocity that is different from the angular velocity of input shaft 14, it is possible to adjust input shaft 14 and output shaft 15 in terms of the angular position to each other. Such a harmonic drive gear is also described, for example, in the publication DE 10 2005 018 956 A1. Input shaft 14, output shaft 15 and adjusting shaft 16 come into operative connection in interaction region 28 by means of internal gear teeth 22, 23 and external gear teeth of steel bushing 21. In addition, variator 5 has sliding bearing section 24 between a carrier of internal gear teeth 23 of output shaft 15 and input shaft 14.

Variator 5 forms internal gear space 25, which is formed by input shaft 14, on the one hand, by means of supporting member 26 and, on the other hand, by means of cover 27, where in this case rolling bearing 18 and interaction region 28 of the external gear teeth of steel bushing 21 and internal gear teeth 22 and 23 are disposed in internal gear space 25 of sliding bearing section 24.

Output shaft 15 is divided into camshaft adapter 29, which is connected in a rotationally fixed manner to camshaft 2, and end cap 30, which is designed as a circular ring member and is also connected in a rotationally fixed manner to camshaft adapter 29. Ring gear section 31 is connected by choice, as shown in the figure, in a rotationally fixed manner to end cap 30 or is formed in one piece with said end cap. Ring gear section 31 bears internal gear teeth 23.

Filter device 32 is integrated into output shaft 15. This filter device is supplied with lubricant by camshaft 2 by means of lubricant feed line 11 and exactly or at least one lubricant inlet 33, which is disposed in output shaft 15, in particular in camshaft adapter 29. Lubricant inlet 33 is designed, for example, as an axially extending lubricant channel that has a first distance from axis of rotation D. As an alternative to the positioning of lubricant inlet 33 in camshaft adapter 29, lubricant inlet 33 may also be disposed radially inwards in a receiving region for camshaft 2, where in this case the alternative position of lubricant inlet 33 is indicated by dashed lines.

Filter device 32 includes lubricant outlet 34, which is also designed in this example as an axially extending lubricant channel, wherein the lubricant channel is spaced apart at a second distance from axis of rotation D, wherein the second distance is designed to be larger than the first distance. Lubricant outlet 34 is integrated into end cap 30 and is open in the direction of inner gear space 25. Filter device 32 comprises filter volume 35, which is arranged, when viewed fluidically, between lubricant inlet 33 and lubricant outlet 34. Filter volume 35 is formed by means of two wall sections **36*a* and 36*b*, where in this case wall section 36*a* is formed by means of an axially oriented end face of end cap 30, and second wall section 36*b* by means of an axially oriented end face of camshaft adapter 29. Wall sections 36*a* and 36*b* extend in a radial plane, which is arranged perpendicular to axis of rotation D. As a result, filter volume 35 is located at the interface between camshaft adapter 29 and end cap 30. Lubricant inlet 33, filter volume 35 and lubricant outlet 34 jointly define exactly or at least one filter path 37, which extends at least in sections in the radial direction with respect to axis of rotation D. This configuration ensures that the length of filter path 37 is artificially lengthened, so that the filtering action of filter device 32 is improved. Filter volume 35 is closed radially at each end, i.e., radially inwards and radially outwards, due to the fact that camshaft adapter 29 and end cap 30 lie one on top of the other in a sealing manner. In particular, filter volume 35 is formed in each instance by means of a recessed region in camshaft adapter 29 and in end cap 30. Instead of providing in each of said components a recessed area, it is also possible to arrange by choice a recess only on the side of camshaft adapter 29 or only on the side of end cap 30, so that filter volume 35 is arranged asymmetrically, especially on one side, with respect to the plane of separation between camshaft adapter 29 and end cap 30**.

Figure 3A:
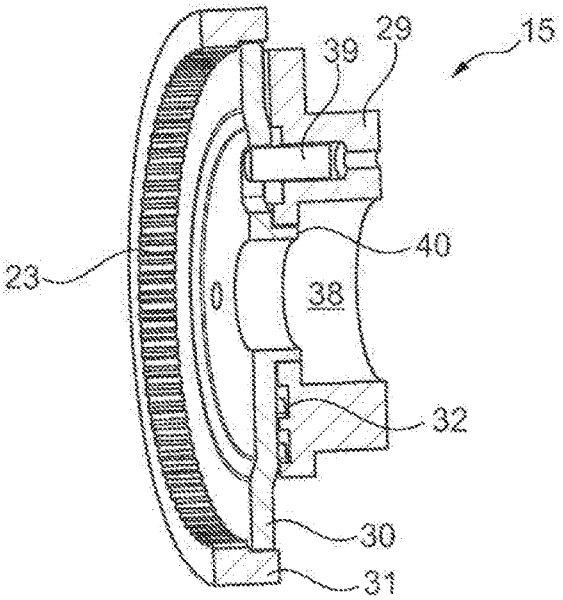
FIG. 3*a, b* is a schematic three-dimensional representation of the camshaft adapter with or without the end cap, as shown in FIG. 2; and, FIGS. 4, 5 are in each case a schematic plan view of the camshaft adapter as another exemplary embodiment of the invention.
Figure 3B:
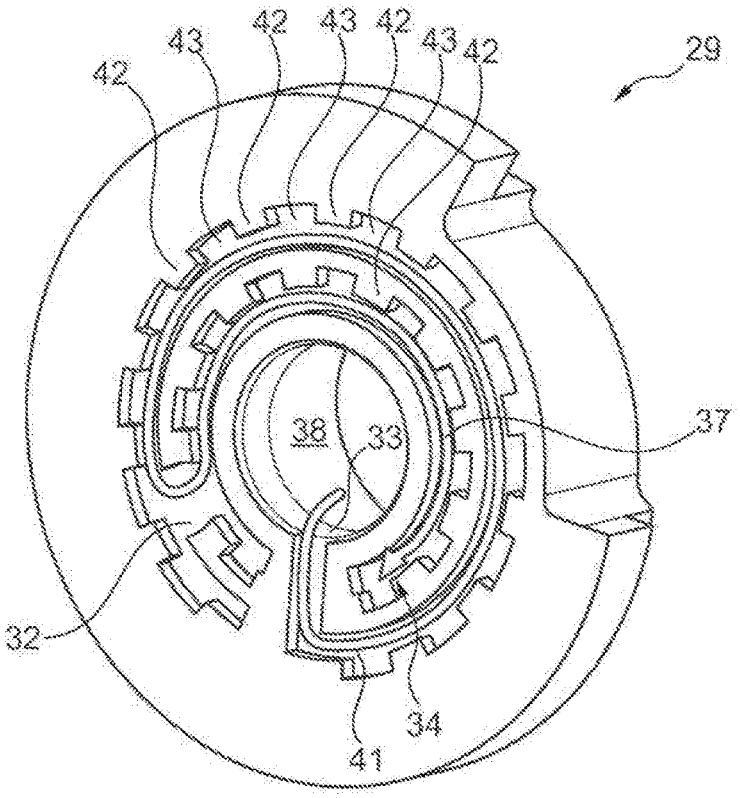

In FIGS. **3*a* and 3*b* output shaft 15 is shown in a schematic three-dimensional sectional view. In FIG. 3*b* camshaft adapter 29 is shown in an individual representation. Camshaft adapter 29 is designed as an annular component, which is arranged coaxially to axis of rotation D. Camshaft adapter 29 has a central receiving opening 38 for an end section of camshaft 2 and can be connected, for example, to end cap 30 in a rotationally fixed manner by means of pin 39. End cap 30 is designed as a circular ring component, which has radially collar 40 on the inner circumference, with said collar being arranged coaxially to receiving opening 38. By inserting collar 40 into receiving opening 38, end cap 30 and camshaft adapter 29 are centered with respect to each other. The connection between the two components can be carried out, for example, by means of a screw connection (not shown). Ring gear section 31 is mounted radially externally on end cap 30 with internal gear teeth 23**.

As can be seen in FIG. 3*b*, lubricant can flow through receiving opening 38 between collar 40 and camshaft adapter 29 to filter device 32, so that the overlapping region between collar 40 and receiving opening 38 forms lubricant inlet 33. Starting from radially inner lubricant inlet 33, lubricant is then fed along filter path 37, which extends in an unbranched manner, into outer region 41, which is located radially outside of lubricant inlet 33 and also lubricant outlet 34. Starting from outer region 41, the lubricant is then initially fed in a first concentric track and is subsequently fed in a labyrinthine manner to a second concentric track, where in this case the second concentric track has a smaller pitch circle diameter than the first concentric track. Furthermore, the flow direction of the lubricant changes with respect to the circumferential direction to axis of rotation D. In particular, filter path 37 has at least one reversal of rotation of the lubricant with respect to axis of rotation D and/or folding. Lubricant outlet 34 is arranged at the end of the second concentric track. The folding of filter path 37 ensures that filter path 37 is artificially extended.

Structural elements 42 are arranged along filter path 37. Such structural elements form dirt pockets 43, which are arranged at the edge along filter path 37 and which are open in the radial direction inward with respect to axis of rotation D. When camshaft adjusting device 1 is running, dirt pockets 43 are filled with lubricating oil. Due to the fact that output shaft 15 rotates together with camshaft 2, the lubricant is conveyed from radially inner lubricant inlet 33 by means of centrifugal force in the direction of filter path 37. At the same time the dirt particles are pushed into dirt pockets 43 due to centrifugal force and can no longer leave also due to centrifugal force, so that the dirt particles are trapped. In addition, switching from the first concentric track to the second concentric track also ensures that only the easily flowing lubricant, but not the dirt particles, can be moved onto the second concentric path, so that it must be assumed that the filtering action is very good.

Filter path 37 is designed as a recess in camshaft adapter 29; in contrast, structural elements 42 are unrecessed regions in the region of filter device 32. Even the walls between the first and the second concentric track are formed by means of continuous structural elements 42. Camshaft adapter 29 implements second wall section 36*b* with this design. In contrast, first wall section 36*a* is designed as a flat region on the side of end cap 30 and seals off the walls of second wall section 36*b*, so that the lubricant can run exclusively along filter path 37. The way along filter path 37 is designed as a flat channel, which has more or less a constant depth in the axial direction in this example.

Since filter path 37 extends in a labyrinthine manner due to the structural elements 42, the way between the lubricant inlet 33 and lubricant outlet 34 is extended by at least a factor of 5, preferably by at least a factor of 10. Thus, the concept of filter device 32 provides that the lubricant, coming from lubricant inlet 33, is first fed radially directly or through loops outwards. The infeed of the lubricant through lubricant outlet 34 into internal gear space 25 is effected on an inner radius.

Described in general terms, one or more concentrically arranged annular grooves can be provided as the tracks, where in this case the innermost of the annular grooves is fluidically connected to lubricant outlet 34; and the outermost of the annular grooves is fluidically connected to lubricant inlet 33.

As an alternative, filter path 37 may be guided in the form of a spiral, where in this case the infeed on the smallest radius is guided by way of a spiral to the largest radius. As an alternative, even in the case of the spiral-shaped course lubricant inlet 33 can be initially connected to an outer section of the spiral, and lubricant outlet 34 can be connected to a radially inner section of the spiral. Another alternative would be a plurality of ray-shaped channels that radiate from one or more lubricant inlets 33 and that open into dirt pockets 43.

Dirt pockets 43 lie outside the lubricant flow. Since filter path 37 has a channel cross-section that is enlarged because of dirt pockets 43, the flow velocity is reduced, so that the dirt particles can be separated by means of the centrifugal force even at low rotational speeds of camshaft 2. Due to the pocket shape of dirt pockets 43, so-called shallow regions are formed, and these shallow regions prevent the dirt particles from being entrained again by the lubricant flow.

Aside from the aforementioned radial expansion of the flow cross-section along filter path 37 due to dirt pockets 43, these dirt pockets may also be expanded in the axial direction, i.e., in the depth.

Additional microstructures on the walls of the channels, in the demolding direction during production, can generate turbulence in order to reduce the flow rate and to improve the process for separating out the dirt particles and the suspended particles.

Figure 4:
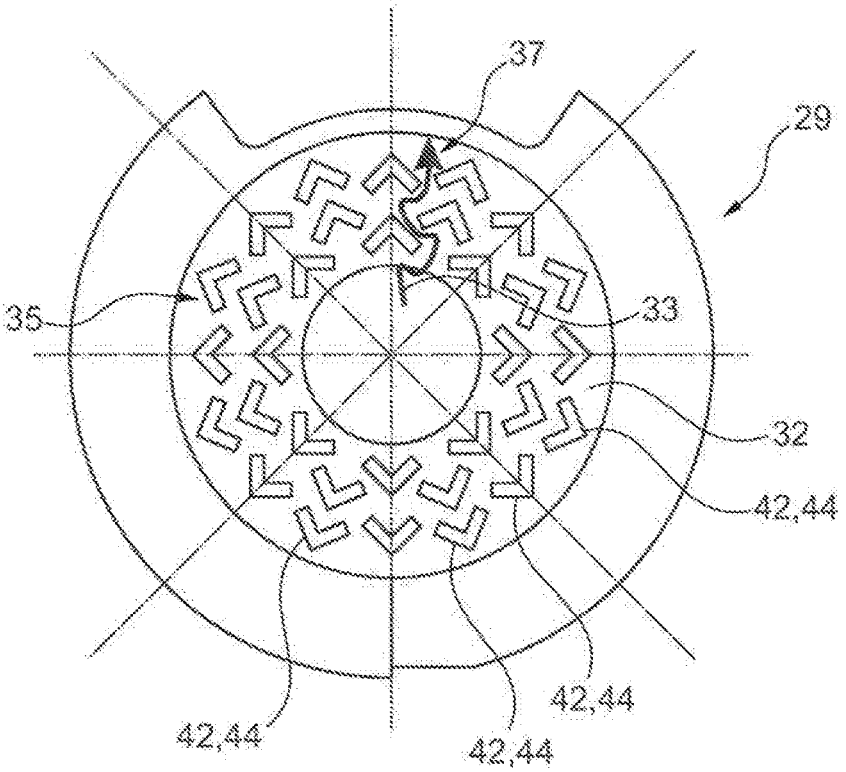

FIG. 4 shows an example embodiment of camshaft adapter 29, where in this case structural elements 42 are arranged and designed in filter device 32 in such a way that these structural elements form free-standing dirt pockets 44. The free-standing dirt pockets 44 are open towards axis of rotation D. In this example embodiment the lubricant, which is fed through radially inner lubricant inlet 33, is guided past free-standing dirt pockets 44 along one or more filter paths 37, which together form a filter path network. In this case it is provided that the dirt particles are trapped again in free-standing dirt pockets 44. Filter device 32 extends in the form of an annular disk by 360 degrees around axis of rotation D.

Figure 5:
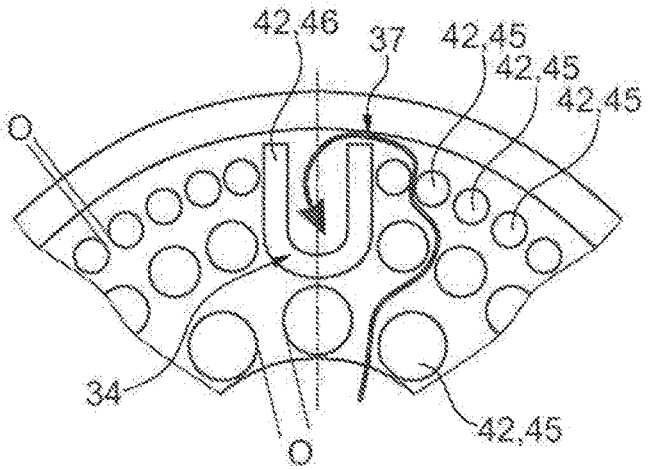

Structural elements 42 may also form flow obstacles 45, as shown in FIG. 5. Owing to the distribution, in particular, owing to an opening width O between flow obstacles 45, filter device 32 may be designed as a classical screen, where in this case the mesh size of the screen is defined by opening width O. Such reduced cross-sections along filter path 37 make it possible to screen large dirt particles out of the lubricant. Free-standing dirt pockets 44, which can be distributed in the screen surfaces, can absorb the dirt particles and, in so doing, can direct said dirt particles away from the lubricant flow. In addition, the free-standing dirt pockets prevent the free cross-sections of the openings from clogging over the runtime; and the volumetric rate of flow of the lubricant is throttled.

Several parallel extending channel sections ensure that the volumetric rate of flow is not substantially throttled in total. In parallel, however, the function of a throttling operation across the width and depth of the channels along filter path 37 can be integrated at the same time.

Additional microstructures on the walls of the channels, in the demolding direction during production, are supposed to generate turbulence in order to improve the process for separating out the dirt particles and the suspended particles.

It is possible to generate different screen planes by staggering opening cross-sections O of the channels of filter paths 37. This being the case, opening widths O are gradually tapered or reduced in size outwards in the radial direction, so that initially larger and later also smaller dirt particles can be sieved out.

FIG. 5 also shows outlet pocket 46, which, in contrast to dirt pockets 43, 44, is open radially outwards, so that only the lubricant, which comes from radially outside and is, therefore, already freed of dirt particles, enters into outlet pocket 46. One of lubricant outlets 34 is arranged in outlet pocket 46. The circumferential boundary of filter volume 35 forms an annular channel as a collector and as an outlet for the lubricant and is fluidically connected to lubricant outlet 34.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

1 camshaft adjusting device
2 camshaft
3 cams
4 drive gear
5 variator
6 electric motor
7 lubricant supply unit
8 oil tank
9 motor oil pump
10 empty
11 lubricant feed line
12 lubricant discharge line
13 motor shaft
14 input shaft
15 output shaft
16 adjusting shaft
17 generator section
18 rolling bearing
19 inner ring
20 outer ring
21 steel bushing
22 internal gear teeth
23 internal gear teeth
24 sliding bearing section
25 internal gear space
26 supporting member
27 cover
28 interaction region
29 camshaft adapter
30 end cap
31 ring gear section
32 filter device
33 lubricant inlet
34 lubricant outlet
35 filter volume
36*a, b* wall sections
37 filter path
38 receiving opening
39 pin
40 collar
41 outer region
42 structural elements
43 dirt pockets
44 free-standing dirt pockets
45 flow obstacles
46 outlet pocket
D axis of rotation
O opening width

What is claimed is:

1. Camshaft adjusting device comprising:

a variator arranged on an axis of rotation for adjusting an angular position of a camshaft, the variator comprising:
an input shaft selectively coupled to a crankshaft;
an output shaft selectively coupled to the camshaft; and,
an adjusting shaft selectively coupled to an actuator;

an internal gear space formed by the variator, wherein the input shaft, the output shaft and the adjusting shaft are operatively connected to each other in the internal gear space;

a lubricant supply unit for supplying the internal gear space with a lubricant, the lubricant supply unit comprising:
a filter device for filtering the lubricant, the filter device comprising:
at least one lubricant inlet;
at least one lubricant outlet; and,
at least one filter path, the filter path fluidically connecting the lubricant inlet and the lubricant outlet;

wherein, the output shaft comprises two wall sections and the at least one filter path is configured in a filter volume between the two wall sections.

2. The camshaft adjusting device as recited in claim 1, wherein the lubricant inlet is at an equal or smaller distance from the axis of rotation than the lubricant outlet, and the filter path extends radially outward from the axis of rotation.

3. The camshaft adjusting device as recited in claim 1, wherein structural elements are disposed in the filter volume and integrally connected to the wall sections and/or are formed by an insert part.

4. The camshaft adjusting device as recited in claim 3, wherein the structural elements form one or more flow obstacles, so that the at least one filter path extends around the flow obstacles.

5. The camshaft adjusting device as recited in claim 3, wherein the structural elements form one or more dirt pockets, wherein the dirt pockets are open radially inward with respect to the axis of rotation.

6. The camshaft adjusting device as recited in claim 3, wherein the structural elements are designed at least partially in the manner of islands.

7. The camshaft adjusting device as recited in claim 3, wherein the percentage of the area of the structural elements, which make contact with the two wall sections, forms at least 50% of the total area of the filter device.

8. The camshaft adjusting device as recited in claim 1, wherein the at least one filter path is formed as a flat channel and extends in the form of a spiral and/or in a labyrinthine manner between the at least one lubricant inlet and the at least one lubricant outlet.

9. The camshaft adjusting device as recited in claim 8, wherein the at least one filter path is guided, starting from the lubricant inlet, to an outer region, which is at a greater radial distance from the axis of rotation than the lubricant outlet and subsequently is guided in the form of a spiral and/or in a labyrinthine manner to the lubricant outlet in a return region.

10. The camshaft adjusting device as recited in claim 1, wherein the at least one filter path is formed as an annular disk and/or as an annular disk segment, wherein preferably an outlet pocket is provided, wherein the outlet pocket is open radially outward.

* * * * *